US009310710B2

(12) United States Patent
Suzuki et al.

(10) Patent No.: US 9,310,710 B2
(45) Date of Patent: Apr. 12, 2016

(54) IMAGE WRITING DEVICE, IMAGE FORMING APPARATUS, AND IMAGE WRITING METHOD

(71) Applicants: Masashi Suzuki, Saitama (JP); Koichi Murota, Tokyo (JP); Tatsuo Ohyama, Kanagawa (JP); Yuichiro Shukuya, Kanagawa (JP); Tatsuya Miyadera, Kanagawa (JP)

(72) Inventors: Masashi Suzuki, Saitama (JP); Koichi Murota, Tokyo (JP); Tatsuo Ohyama, Kanagawa (JP); Yuichiro Shukuya, Kanagawa (JP); Tatsuya Miyadera, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/632,188

(22) Filed: Feb. 26, 2015

(65) Prior Publication Data

US 2015/0261117 A1 Sep. 17, 2015

(30) Foreign Application Priority Data

Mar. 14, 2014 (JP) ..... 2014-052596

(51) Int. Cl.
*G03G 15/043* (2006.01)

(52) U.S. Cl.
CPC ..... *G03G 15/043* (2013.01)

(58) Field of Classification Search
CPC ..... G03G 15/043
See application file for complete search history.

(56) References Cited

U.S. PATENT DOCUMENTS

| | | | | |
|---|---|---|---|---|
| 5,055,860 | A * | 10/1991 | Bannai | G06K 15/1219 347/249 |
| 2002/0063771 | A1* | 5/2002 | Nozaki | G06K 15/1219 347/235 |
| 2004/0119811 | A1* | 6/2004 | Bush | B41J 2/47 347/237 |
| 2012/0057889 | A1 | 3/2012 | Yamaguchi et al. | |
| 2012/0147114 | A1 | 6/2012 | Yokoyama et al. | |
| 2012/0154827 | A1 | 6/2012 | Shirasaki et al. | |
| 2012/0207498 | A1 | 8/2012 | Miyadera et al. | |
| 2012/0262750 | A1 | 10/2012 | Kinoshita et al. | |
| 2012/0287479 | A1 | 11/2012 | Takahashi et al. | |
| 2012/0288291 | A1 | 11/2012 | Miyadera | |

(Continued)

FOREIGN PATENT DOCUMENTS

| | | |
|---|---|---|
| JP | 7-225544 | 8/1995 |
| JP | 2013-039798 | 2/2013 |

*Primary Examiner* — Sandra Brase
(74) *Attorney, Agent, or Firm* — Harness, Dickey & Pierce, P.L.C.

(57) ABSTRACT

An image writing device includes an exposure device to repeatedly expose a surface of an image bearer along a main-scanning direction during an image forming period to write an image on the image bearer, a speed change detector to detect a change in moving speed in a sub-scanning direction of the surface of the image bearer, a first signal generation circuit to generate a first signal, an image forming period signal generation circuit to generate an image forming period signal synchronously with the first signal, a second signal generation circuit to generate a second signal, the second signal initially appearing in the image forming period being in synchronization with the first signal, and a line synchronization signal generation circuit to generate a line synchronization signal synchronously with the second signal and transmit the line synchronization signal to the exposure device during the image forming period.

12 Claims, 6 Drawing Sheets

(56) References Cited

U.S. PATENT DOCUMENTS

| | | | |
|---|---|---|---|
| 2013/0044176 | A1 | 2/2013 | Shirasaki et al. |
| 2013/0070040 | A1 | 3/2013 | Miyadera et al. |
| 2013/0207339 | A1 | 8/2013 | Yokoyama et al. |
| 2013/0242318 | A1 | 9/2013 | Yamaguchi et al. |
| 2013/0300815 | A1 | 11/2013 | Kinoshita et al. |
| 2014/0028773 | A1 | 1/2014 | Miyadera |
| 2014/0125752 | A1 | 5/2014 | Miyadera |
| 2014/0146120 | A1 | 5/2014 | Miyadera |
| 2014/0146371 | A1 | 5/2014 | Hayashi et al. |
| 2014/0152754 | A1 | 6/2014 | Murakami et al. |
| 2014/0153042 | A1 | 6/2014 | Kawanabe et al. |
| 2014/0204429 | A1 | 7/2014 | Miyadera et al. |

* cited by examiner

IMAGE WRITING DEVICE, IMAGE FORMING APPARATUS, AND IMAGE WRITING METHOD

CROSS-REFERENCE TO RELATED APPLICATION

This patent application is based on and claims priority pursuant to 35 U.S.C. §119(a) to Japanese Patent Application No. 2014-052596, filed on Mar. 14, 2014, in the Japan Patent Office, the entire disclosure of which is hereby incorporated by reference herein.

BACKGROUND

1. Technical Field

This disclosure relates to an image writing device that writes an image on a surface of a photoconductor moving in a sub-scanning direction at a predetermined speed by repeatedly exposing the surface of the photoconductor along a main-scanning direction with an exposure head having a plurality of light-emitting elements arranged in the main-scanning direction, an image forming apparatus equipped with the image writing device, and an image writing method.

2. Related Art

Electrophotographic image forming apparatuses are widely used as a copier, a printer, a facsimile machine, a digital multifunction peripheral, or the like. Such apparatuses are equipped with an image writing device that exposes a surface of a photoconductor to write an image, i.e., form an electrostatic latent image, thereon. The image forming apparatus develops the electrostatic latent image formed on the surface of the photoconductor by the image writing device with a developer such as a toner to form a toner image, transfers the toner image onto a recording medium such as a sheet, fixes the toner image on the recording medium, and outputs the recording medium to the outside of the image forming apparatus.

Although formerly a laser-writing (i.e., raster optical system) type of image writing device used to be the dominant type of image writing device included in the above-described image forming apparatus, an image writing device employing a fixed writing system with an exposure head like the above-described one has been increasingly used in recent years. A light-emitting diode (LED) array including a plurality of LED elements serving as light-emitting elements arranged in the main-scanning direction at a density corresponding to the resolution is typically used as the exposure head.

The image writing device with the LED array exposes the charged surface of the photoconductor to the light emitted by the LED elements of the LED array, to thereby write an image, i.e., form an electrostatic latent image, on the photoconductor. ON and OFF of the LED elements in the LED array are controlled by an LED array drive unit based on image data to be written, which is stored in a line memory for each main-scanning line and transmitted to the LED array drive unit at line periods each corresponding to the resolution.

In such an image writing device or an image forming apparatus equipped with such an image writing device, if a change occurs in the moving speed in the sub-scanning direction of a surface of an image bearer such as a photoconductor, image unevenness (i.e., density unevenness) and image misregistration occur in the sub-scanning direction. Herein, the image bearer such as a photoconductor corresponds to a photoconductor such as a photoconductor drum or a photoconductor belt or a member having a surface to which an image written on the surface of the photoconductor is directly or indirectly transferred, and which moves in the sub-scanning direction.

There are methods to correct such image unevenness and image misregistration due to the change in the moving speed in the sub-scanning direction of the surface of such an image bearer. For example, a change in the rotation speed of a photoconductor drum serving as the image bearer may be detected with an encoder, and the timing of generating a line synchronization signal (i.e., horizontal synchronization signal) HSYNC adjusted based on the detection result to correct the image unevenness and image misregistration in the sub-scanning direction.

SUMMARY

In one embodiment of this disclosure, there is provided an improved image writing device that, in one example, includes at least one exposure device, at least one speed change detector, at least one first signal generation circuit, at least one image forming period signal generation circuit, at least one second signal generation circuit, and at least one line synchronization signal generation circuit. The at least one exposure device includes an exposure head having a plurality of light-emitting elements arranged in a main-scanning direction perpendicular to a sub-scanning direction in a plane extending along a surface of at least one image bearer that moves in the sub-scanning direction at a predetermined speed. The at least one exposure device uses the exposure head to repeatedly expose the surface of the at least one image bearer along the main-scanning direction during an image forming period to write an image on the surface of the at least one image bearer. The at least one speed change detector detects a change in a moving speed in the sub-scanning direction of the surface of the at least one image bearer. The at least one first signal generation circuit generates a first signal having a constant period shorter than a period corresponding to a writing resolution in the sub-scanning direction. The at least one image forming period signal generation circuit generates, in synchronization with the first signal, an image forming period signal specifying the image forming period. The at least one second signal generation circuit generates a second signal having a period based on the period corresponding to the writing resolution in the sub-scanning direction and adjusted to reduce the effect of the detected change in the moving speed. The second signal initially appearing in the image forming period is in synchronization with the first signal. The at least one line synchronization signal generation circuit generates, in synchronization with the second signal, a line synchronization signal specifying timing of the exposure, and transmits the line synchronization signal to the at least one exposure device during the image forming period.

In one embodiment of this disclosure, there is provided an improved image forming apparatus that, in one example, includes the above-described image writing device and an image forming device to develop the image written on the surface of the at least one image bearer in the image writing device and transfer the image onto a recording medium.

In one embodiment of this disclosure, there is provided an improved image writing method of writing an image on a surface of an image bearer that moves in a sub-scanning direction at a predetermined speed by repeatedly exposing the surface of the image bearer along a main-scanning direction perpendicular to the sub-scanning direction during an image forming period with an exposure head having a plurality of light-emitting elements arranged in the main-scanning direction in a plane extending along the surface of the image bearer. The image writing method includes, for example, detecting a change in a moving speed in the sub-scanning direction of the surface of the image bearer, generating a first signal having a constant period shorter than a period corresponding to a writing resolution in the sub-scanning direction, generating, in synchronization with the first signal, an image forming period signal specifying the image forming period, generating, with a second signal generation circuit, a second signal having a period based on the period corresponding to the writing resolution in the sub-scanning direction and adjusted to reduce the effect of the detected change in the moving speed, the second signal initially appearing in the image forming period being in synchronization with the first signal, and generating, in synchronization with the second signal, a line synchronization signal specifying timing of the exposure during the image forming period.

BRIEF DESCRIPTION OF THE DRAWINGS

A more complete appreciation of this disclosure and many of the advantages thereof are obtained as the same becomes better understood by reference to the following detailed description when considered in connection with the accompanying drawings, wherein.

DETAILED DESCRIPTION

Figure 1:
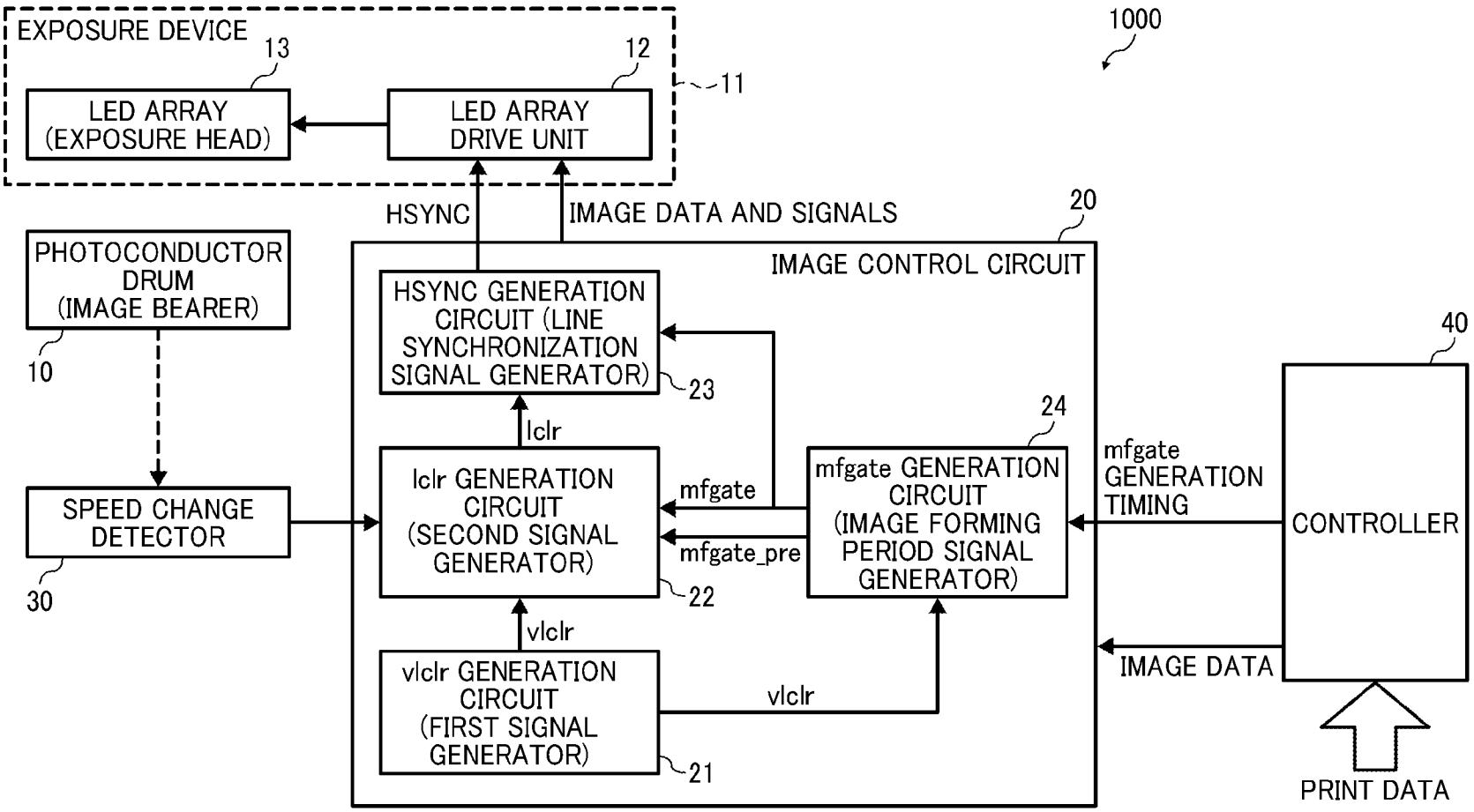
FIG. 1 is a block diagram illustrating a configuration of main components of an image writing device according to an embodiment of this disclosure.

In describing the embodiments illustrated in the drawings, specific terminology is adopted for clarity. However, this disclosure is not intended to be limited to the specific terminology so used, and it is to be understood that substitutions for each specific element can include any technical equivalents that have the same function, operate in a similar manner, and achieve a similar result.

Referring now to the drawings, wherein like reference numerals designate identical or corresponding parts throughout the several views, embodiments for implementing this disclosure will be specifically described below.

Description will now be given of an image writing device and an image writing method according to an embodiment of this disclosure. An image writing device according to an embodiment of this disclosure will first be described with reference to FIGS. 1 and 2.

Figure 2:
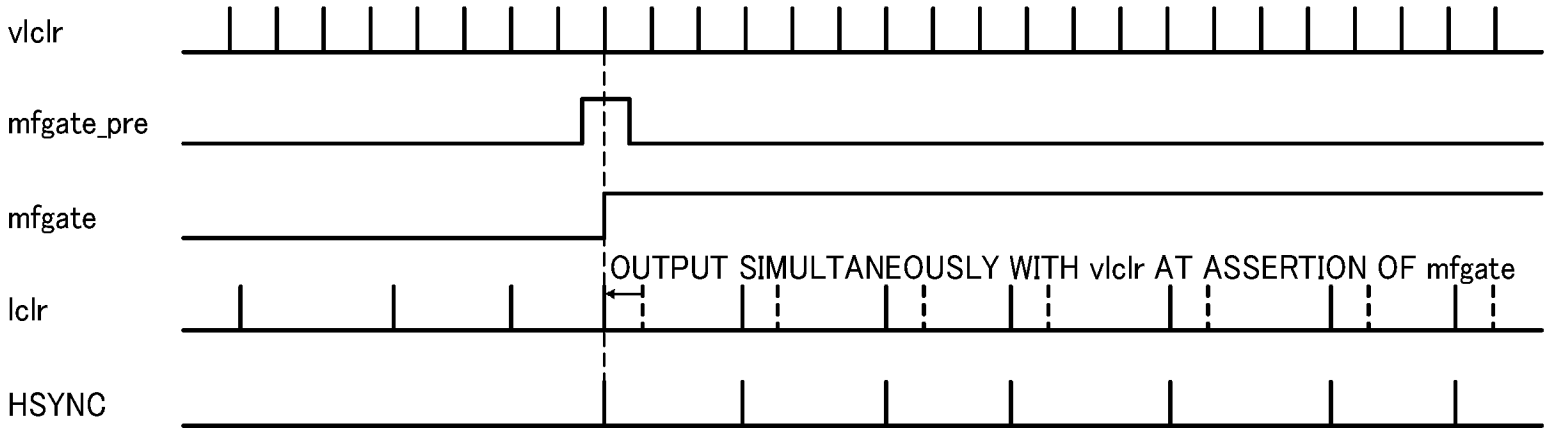
FIG. 2 is a timing chart illustrating the relationship between signals used in an image writing method employed by the image writing device illustrated in FIG. 1.

FIG. 1 is a block diagram illustrating a configuration of main components of an image writing device 1000 according to an embodiment of this disclosure. FIG. 2 is a timing chart illustrating the relationship between signals used in an image writing method employed by the image writing device 1000.

The image writing device 1000 illustrated in FIG. 1 includes a photoconductor drum 10 and an exposure device 11. The photoconductor drum 10 serving as an image bearer is a photoconductor whose outer circumferential surface serves as an image bearing surface for bearing an image and rotates to move in a sub-scanning direction at a predetermined speed (i.e., target speed). The exposure device 11 exposes the surface of the photoconductor drum 10 to write an image thereon.

The exposure device 11 includes a light-emitting diode (LED) array 13 and an LED array drive unit 12 for driving the LED array 13. The LED array 13 is an exposure head having a plurality of light-emitting elements arranged in a main-scanning direction (i.e., the axial direction of the photoconductor drum 10) perpendicular to the sub-scanning direction in a plane extending along the surface of the photoconductor drum 10. Specifically, a multitude of LED elements, i.e., light-emitting elements serving as light sources, are arranged along the longitudinal direction of the LED array 13 in an array at a density corresponding to the writing resolution in the main-scanning direction.

The image writing device 1000 further includes an image control circuit 20 and a speed change detector 30. During an image forming period, the LED array drive unit 12 drives the LED elements of the LED array 13 to flash in accordance with image data transmitted from the image control circuit 20, to thereby repeatedly expose the surface of the photoconductor drum 10 along the main-scanning direction to write an image thereon.

A controller 40 is a control unit that controls the entire image forming apparatus equipped with the image writing device 1000. The controller 40 includes a microcomputer including a central processing unit (CPU), a read-only memory (ROM), a random access memory (RAM), and so forth. The controller 40 has an image processing function to receive print data from an external device, develop the print data into pages of bit-map image data, and transmit the image data to the image control circuit 20 line by line.

The image control circuit 20 receives the image data transmitted from the controller 40, processes the image data into an ultimate format for causing the LED array 13 to emit light, and transmits the processed image data to the LED array drive unit 12 of the exposure device 11. The image control circuit 20 also transmits signals such as a pixel clock and a strobe signal to the LED array drive unit 12 together with the image data. The image control circuit 20 further transmits a line synchronization signal (i.e., horizontal synchronization signal) HSYNC, which specifies the timing of exposure performed at line periods by the exposure device 11, to the LED array drive unit 12.

The image control circuit 20 transmits the image data line by line to the LED array drive unit 12 in synchronization with the pixel clock. If the LED array drive unit 12 receives one line of image data, the LED array drive unit 12 temporarily latches the image data with a rise of the line synchronization signal HSYNC. With the strobe signal synchronized with the next rise of the line synchronization signal HSYNC, the LED array drive unit 12 causes the LED elements of the LED array 13 to emit light at one time in accordance with the one line of image data, while receiving the next line of image data. Although the LED array drive unit 12 may be integrated with the LED array 13, FIG. 1 illustrates the LED array drive unit 12 and the LED array 13 separately for ease of illustration.

The image control circuit 20 according to the present embodiment includes a vlclr generation circuit 21, an lclr generation circuit 22, an HSYNC generation circuit 23, and an mfgate generation circuit 24, which serve as a first signal generator, a second signal generator, a line synchronization signal generator, and an image forming period signal generator, respectively, as indicated in parentheses in FIG. 1. The image control circuit 20 includes a microcomputer including a CPU, a ROM, a RAM, and so forth similarly to the controller 40. A combination of hardware and software processing performed by the microcomputer realizes the functions of the first signal generator, the second signal generator, the line synchronization signal generator, and the image forming period signal generator.

The vlclr generation circuit 21 serving as the first signal generator generates a first signal vlclr having a constant period shorter than a period corresponding to the writing resolution in the sub-scanning direction. The first signal vlclr is for precisely controlling the timing of starting the image formation.

The mfgate generation circuit 24 serving as the image forming period signal generator generates (i.e., asserts) an image forming period signal mfgate, which specifies the image forming period, in synchronization with the first signal vlclr.

The lclr generation circuit 22 serving as the second signal generator generates a second signal lclr having a period based on the period corresponding to the writing resolution in the sub-scanning direction and adjusted to reduce the effect of any change in speed detected by the speed change detector 30. When the mfgate generation circuit 24 generates (i.e., asserts) the image forming period signal mfgate, the lclr generation circuit 22 generates, in synchronization with the first signal vlclr, the second signal lclr initially appearing in the image forming period, which serves as a light emission period line clear signal.

The writing resolution is usually the same between the main-scanning direction and the sub-scanning direction, but may be different in some cases.

During the image forming period in which the image forming period signal mfgate is generated, the HSYNC generation circuit 23 serving as the line synchronization signal generator generates, in synchronization with the second signal lclr, the line synchronization signal HSYNC that specifies the timing of exposure by the exposure device 11, and transmits the line synchronization signal HSYNC to the exposure device 11.

The present embodiment is configured as follows to allow the lclr generation circuit 22 to generate, in synchronization with the first signal vlclr, the second signal lclr initially appearing in the image forming period, when the mfgate generation circuit 24 generates (i.e., asserts) the image forming period signal mfgate.

When the mfgate generation circuit 24 is notified of the timing of generating the image forming period signal mfgate by the controller 40, the mfgate generation circuit 24 transmits a notification signal mfgate_pre, which signals the approach of the image forming period, to the lclr generation circuit 22 immediately before the image forming period. The lclr generation circuit 22 receives the notification signal mfgate_pre and synchronizes the second signal lclr initially generated in the image forming period with the first signal vlclr immediately following the notification signal mfgate_pre.

The controller 40 may employ any method capable of notifying the mfgate generation circuit 24 of the timing of generating the image forming period signal mfgate. For example, the controller 40 may notify the mfgate generation circuit 24 of the timing of generating the image forming period signal mfgate with the notification signal mfgate_pre itself, a numerical value such as a line number indicating the number of lines preceding the image forming period, or information indicating the number of first signals vlclr following the assertion of the notification signal mfgate_pre and preceding the image forming period.

If the mfgate generation circuit 24 receives the notification signal mfgate_pre from the controller 40, the mfgate generation circuit 24 directly forwards the notification signal mfgate_pre to the lclr generation circuit 22. If the mfgate generation circuit 24 is notified of the timing of generating the image forming period signal mfgate in another form of information, the mfgate generation circuit 24 generates the notification signal mfgate_pre based on that information and transmits the notification signal mfgate_pre to the lclr generation circuit 22. Alternatively, the mfgate generation circuit 24 may directly forward the received information to the lclr generation circuit 22 as the notification signal mfgate_pre. In that case, the lclr generation circuit 22 determines the timing of generating the image forming period signal mfgate based on the received information.

The speed change detector 30 detects the change in the speed at which a surface of an image bearer such as the photoconductor drum 10 moves in the sub-scanning direction. The image bearer may be a photoconductor (e.g., a photoconductor drum or a photoconductor belt) or a member having a surface to which an image written on a surface of the photoconductor is transferred, and which moves in the sub-scanning direction. Such a member may be, for example, a recording medium such as a transfer sheet onto which the image is ultimately output or an intermediate transfer member such as an intermediate transfer belt or an intermediate transfer drum included in a color image forming apparatus.

The speed change detector 30 detects the change in the moving speed in the sub-scanning direction of the surface of the image bearer by detecting a change in the rotation speed of a rotary shaft of the image bearer, a motor for driving the image bearer, or a member forming a mechanism that transmits the drive force of the motor to the image bearer. For example, the change in the rotation speed may be detected by a combination of an encoder and an encoder detection circuit, as in a specific example described later.

A change in speed detected by the speed change detector 30 is transmitted to the lclr generation circuit 22 to allow the lclr generation circuit 22 to adjust the period of the second signal lclr to be generated so as to reduce the effect of the change in the moving speed in the sub-scanning direction of the surface of the image bearer, thereby minimizing image unevenness and image misregistration due to the change in the above-described moving speed.

With reference to the timing chart illustrated in FIG. 2, description will now be given of the operations of the circuits in the image control circuit 20 of the above-described image writing device 1000 and the image writing method according to the present embodiment.

The first signal vlclr illustrated in FIG. 2 is a pulse signal having a constant period shorter than the period corresponding to the writing resolution in the sub-scanning direction, and serves as a basis for the assertion of the image forming period signal mfgate. The shorter the period (i.e., the higher the frequency) of the first signal vlclr is, therefore, the higher the resolution of the timing of asserting the image forming period signal mfgate is. Accordingly, the timing of asserting the image forming period signal mfgate is precisely controlled.

The image forming period signal mfgate specifying the image forming period is asserted (i.e., set to "1") in synchronization with the first signal vlclr when the image forming period starts.

The second signal lclr serving as the light emission period line clear signal used during the assertion of the image forming period signal mfgate is a pulse signal using the period corresponding to the writing resolution in the sub-scanning direction as a reference period. The period of the second signal lclr, however, is finely adjusted in accordance with the change in the moving speed in the sub-scanning direction of the surface of the image bearer detected by the speed change detector 30 in order to correct the image unevenness (i.e., density unevenness) and the image misregistration due to periodical changes in the moving speed in the sub-scanning direction of the surface of the image bearer. Therefore, the period of the second signal lclr changes and is normally asynchronous with the first signal vlclr.

When the image forming period signal mfgate is generated (i.e., asserted), however, the second signal lclr initially generated in the image forming period is synchronized with the first signal vlclr. The times scheduled for generating the second signal lclr are indicated by broken lines in FIG. 2. Since the initial second signal lclr is output in synchronization with the first signal vlclr when the image forming period signal mfgate is asserted, the times for generating all subsequent second signals lclr are advanced by the time by which the generation of the initial second signal lclr is advanced, as indicated by solid lines in FIG. 2.

The line synchronization signal HSYNC is a pulse signal generated in synchronization with the second signal lclr during the image forming period in which the image forming period signal mfgate is generated, and specifies the timing of exposure by the exposure device 11, as described above.

If the period of the first signal vlclr is adjusted to the period corresponding to the writing resolution in the sub-scanning direction similarly to the period of the second signal lclr, sub-scanning registration correction, i.e., correction of misregistration of the image writing start position in the sub-scanning direction, is performed only at writing resolution intervals.

Although it may be conceivable to improve the writing resolution, such an approach requires higher performance, such as a higher pixel frequency for allowing high-speed internal processing, resulting in an increase in cost. This approach also entails high-speed transmission of image data, which raises the risk of increasing the effect of electromagnetic noise (i.e., electromagnetic interference: EMI) on the surroundings.

As described above, therefore, the second signal lclr having the period corresponding to the intended writing resolution in the sub-scanning direction is used as the light emission period line clear signal during the image forming period, while the first signal vlclr irrelevant to the second signal lclr is used for the sub-scanning registration correction. Further, the period of the first signal vlclr is set to be shorter than the period of the second signal lclr to allow precise sub-scanning registration at periods shorter than the line periods. In the present example, the period of the first signal vlclr is set to approximately one third of the period of the second signal lclr.

The first signal vlclr and the second signal lclr operate asynchronously. If the image forming period signal mfgate is asserted in synchronization with the first signal vlclr, therefore, the second signals lclr after the assertion are generated at different times. Consequently, the timing of exposure for the first line on each page varies, raising the possibility of image misregistration despite the adjustment of the sub-scanning registration with the light emission period line clear signal (i.e., the first signal vlclr in this case).

Therefore, the second signal lclr is synchronized with the light emission period line clear signal (i.e., the first signal vlclr in this case) at the assertion of the image forming period signal mfgate. This results in a fluctuation in period between the second signal lclr before the assertion of the image forming period signal mfgate and the second signal lclr at the time of assertion. However, such a difference does not cause a serious problem, since the image formation is not performed before the assertion of the image forming period signal mfgate.

After the second signal lclr is synchronized with the first signal vlclr at the time of assertion of the image forming period signal mfgate to be synchronized with the start of the image formation, the second signal lclr is again generated at the periods corresponding to the predetermined writing resolution in the sub-scanning direction.

In the example illustrated in FIG. 2, the notification signal mfgate_pre for signaling the approach of the image forming period is used to synchronize the second signal lclr with the first signal vlclr at the time of assertion of the image forming period signal mfgate. The notification signal mfgate_pre is asserted before the assertion of the image forming period signal mfgate to signal that the image forming period signal mfgate will be asserted with the first signal vlclr immediately following the notification signal mfgate_pre.

In the present example, the notification signal mfgate_pre is asserted between the first signal vlclr at the time of assertion of the image forming period signal mfgate and the first signal vlclr immediately before the assertion of the image forming period signal mfgate.

In a period in which the image forming period signal mfgate is negated, the first signal vlclr and the second signal lclr operate asynchronously. With the second signal lclr adjusted to the asserted first signal vlclr in accordance with the notification signal mfgate_pre, however, the assertion of the image forming period signal mfgate is synchronized with the generation of the first signal vlclr and the second signal lclr.

The notification signal mfgate_pre is negated when the mfgate generation circuit 24 recognizes that the image forming period signal mfgate has been asserted or that the first signal vlclr or the second signal lclr has been generated.

The foregoing description has been given of an example in which the image forming period signal mfgate is asserted with the first signal vlclr immediately following the assertion of the notification signal mfgate_pre. However, the relationship between the time of generating the notification signal mfgate_pre and the time of asserting the image forming period signal mfgate following the notification signal mfgate_pre is not limited thereto. As long as the assertion of the image forming period signal mfgate is reported in advance to the lclr generation circuit 22 and the first signal vlclr and the second signal lclr are matched in phase with each other at the time of assertion of the image forming period signal mfgate, the method therefor is not limited.

The controller 40 illustrated in FIG. 1 may calculate the time for starting image formation from, for example, the start-up of a positioning roller pair that feeds a transfer sheet (i.e., a recording medium) to a transfer position at which a toner image formed on the surface of the photoconductor drum 10 is transferred to the transfer sheet. Alternatively, the controller 40 may calculate the time for starting image formation from the time of detection of a signal input to the controller 40 to signal that a leading end of the transfer sheet conveyed in the sub-scanning direction has been detected at a position upstream of the transfer position by a predetermined distance. Methods for the above calculation use existing techniques, and thus description thereof will be omitted.

If multiple sets of the photoconductor drum 10, the exposure device 11, and the circuits of the image control circuit 20 illustrated in FIG. 1 are prepared and multiple sets (e.g., four sets for four colors) of the signals illustrated in FIG. 2 are used, adjustment of the sub-scanning registration for each color is precisely performed in a color image forming apparatus, also allowing precise correction of the sub-scanning registration between the colors.

An image forming apparatus according to an embodiment of this disclosure will now be described.

Figure 3:
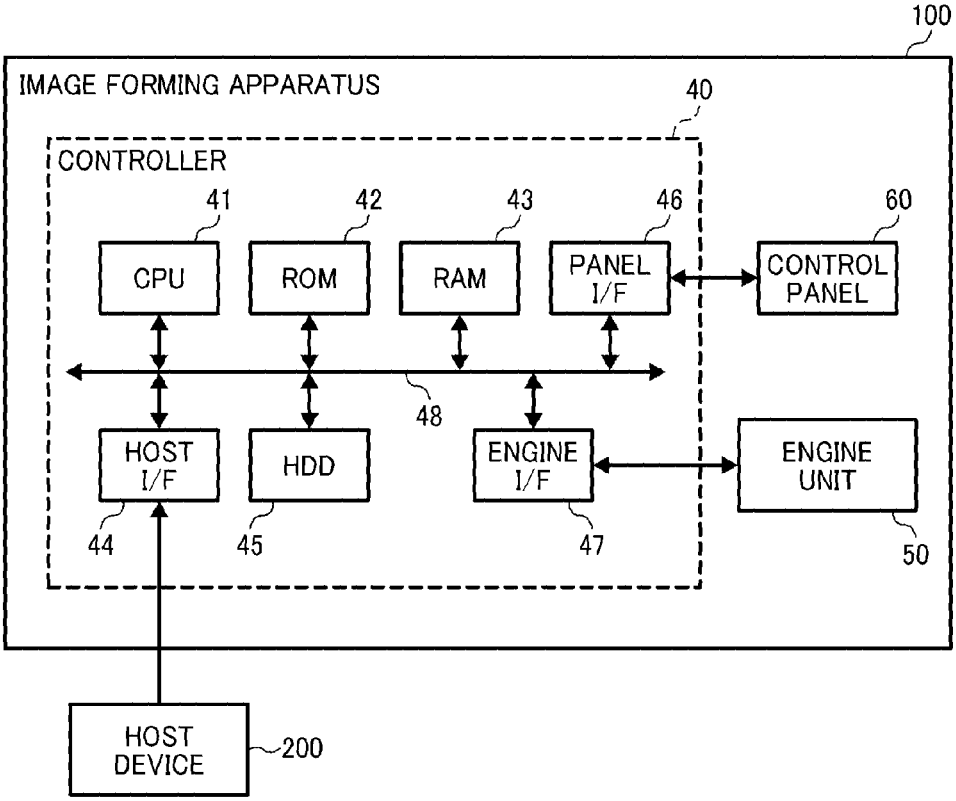
FIG. 3 is a block diagram illustrating an overall configuration of an image forming apparatus according to an embodiment of this disclosure.
Figure 4:
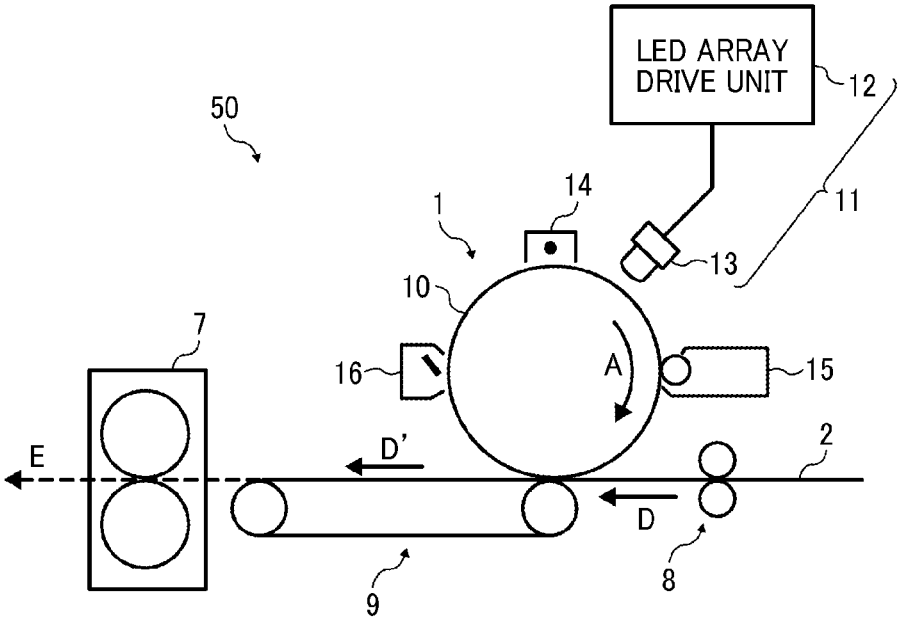
FIG. 4 is a schematic diagram illustrating a configuration of components near an image forming unit in an engine unit of the image forming apparatus.

FIG. 3 is a block diagram illustrating an overall configuration of an image forming apparatus 100 according to an embodiment of this disclosure. FIG. 4 is a schematic diagram illustrating a configuration of components near an image forming unit 1 in an engine unit (also referred to as printer engine) 50 of the image forming apparatus 100.

The image forming apparatus 100 illustrated in FIG. 3 includes the controller 40, the engine unit 50, and a control panel (i.e., operation panel) 60.

The controller 40 also illustrated in FIG. 1 is a control unit that controls the entire image forming apparatus 100. The controller 40 includes a microcomputer having a CPU 41, a ROM 42, a RAM 43, a host interface (I/F) 44, a hard disk drive (HDD) 45, a panel I/F 46, and an engine I/F 47 connected to one another by a system bus 48 to exchange data, addresses, and control signals.

The CPU 41 is a central processing unit that controls the image forming apparatus 100 as a whole by selectively executing, in the RAM 43 serving as a work area, programs stored in the ROM 42 or the HDD 45. The ROM 42 is a read-only memory that previously stores the programs executed by the CPU 41 and fixed data necessary for the execution of the programs. The RAM 43 is a readable and writable memory that is used as the work area in the execution of the programs by the CPU 41 and stores temporary data.

The host I/F 44 is an interface that allows the controller 40 to communicate with a host device 200, which is an information processor such as a personal computer, via a network to receive print data transmitted from the host device 200. The HDD 45 is a non-volatile mass storage device that stores the programs executed by the CPU 41, the fixed data necessary for the execution of the programs, a variety of setting values, and so forth in a hard disk. The HDD 45 is also capable of temporarily storing the received print data. The image forming apparatus 100 may include a non-volatile memory such as a non-volatile RAM in place of or in addition to the HDD 45. The panel I/F 46 is an interface that allows the controller 40 to exchange signals and data with the control panel 60. The control panel 60 includes a display unit such as a liquid crystal display and keys provided to, for example, a front or upper surface of a housing of the image forming apparatus 100 to be manually operated.

The engine I/F 47 is an interface that allows the controller 40 to exchange signals and data with the engine unit 50 including an image forming mechanism that actually forms an image and a drive circuit that drives the image forming mechanism. More specifically, the engine unit 50 includes the photoconductor drum 10, the exposure device 11, the image control circuit 20, and the speed change detector 30 described above with reference to FIG. 1.

As described above, the controller 40 has the image processing function to develop the print data received from the host device 200 into pages of bit-map image data in a memory such as the RAM 43 and transmit the image data to the image control circuit 20 in the engine unit 50 line by line. The controller 40 also performs a process of notifying the image control circuit 20 in the engine unit 50 of the aforementioned timing of generating the image forming period signal mfgate.

With reference to FIG. 4, description will be given of a configuration example of components near the image forming unit 1 in the engine unit 50.

In the present embodiment, the engine unit 50 serves as an image forming device including the image forming unit 1 that forms a unicolor image on a transfer sheet 2 serving as a recording medium in accordance with electrophotographic image formation.

The image forming unit 1 includes the photoconductor drum 10 and a charger 14, the LED array 13, a developing device 15, a photoconductor cleaner 16, and a transfer conveyance belt 9 disposed around the photoconductor drum 10. The LED array 13 also forms part of the exposure device 11 in FIG. 1 together with the LED array drive unit 12.

A positioning roller pair (also referred to as a registration roller pair) 8 is provided at a position upstream of a transfer position, at which the outer circumferential surface (i.e., image bearing surface) of the photoconductor drum 10 contacts the transfer conveyance belt 9, in the transfer sheet conveying direction (i.e. sub-scanning direction) indicated by arrow D. The positioning roller pair 8 clamps and temporarily stops the leading end of the transfer sheet 2 conveyed from a sheet feeding unit. The positioning roller pair 8 is then restarted with the start time of image writing by the LED array 13 adjusted such that the leading end of the toner image on the photoconductor drum 10 and the leading end of an image transfer region in the transfer sheet 2 face each other at the transfer position, to thereby convey the transfer sheet 2 in the direction of arrow D.

The photoconductor drum 10 in the image forming unit 1 is rotated at a predetermined speed in the direction of arrow A, and the photosensitive surface of the photoconductor drum 10 is uniformly charged by the charger 14 at a predetermined time.

Then, with the light emitted from the LED elements of the LED array 13, the surface of the photoconductor drum 10 is repeatedly exposed along the main-scanning direction corresponding to the axial direction of the photoconductor drum 10 (i.e., a direction perpendicular to the drawing plane of FIG. 4). In this case, the moving direction of the surface of the photoconductor drum 10 with the rotation of the photoconductor drum 10 corresponds to the sub-scanning direction. Thereby, an electrostatic latent image is formed on the surface of the photoconductor drum 10.

The electrostatic latent image is developed at the developing device 15 with a toner serving as a developer, thereby forming a toner image on the surface of the photoconductor drum 10. Black toner is usually used to form a unicolor image.

The toner image is directly transferred onto a surface of the transfer sheet 2 at the transfer position at which the photoconductor drum 10 contacts the transfer sheet 2 on the transfer conveyance belt 9, thereby forming a toner image on the transfer sheet 2. Residual toner remaining on the surface of the photoconductor drum 10 is cleaned off by the photoconductor cleaner 16 to prepare for the next image formation.

The transfer sheet 2 passed through the image forming unit 1 and having the toner image transferred thereto is conveyed in the direction of arrow D' by the transfer conveyance belt 9 to be sent to a fixing device 7. The transfer sheet 2 is subjected to heat and pressure during the passage through the fixing device 7 to fix the toner image thereon, and is ejected in the direction of arrow E.

Figure 5:
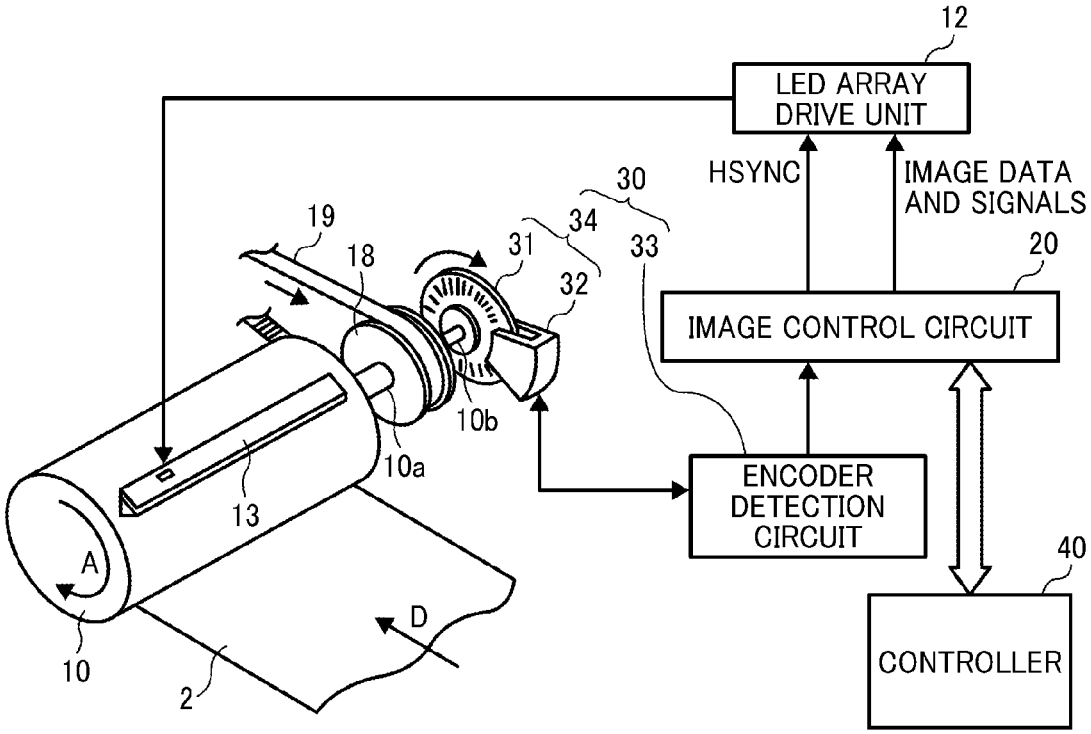
FIG. 5 is a schematic diagram illustrating a configuration of an example of a speed change detector in the engine unit of the image forming apparatus and related units of the image writing device illustrated in FIG. 1.

FIG. 5 is a schematic diagram illustrating a configuration of an example of the speed change detector 30 in the engine unit 50 and related units of the image writing device 1000 illustrated in FIG. 1. As illustrated in FIG. 5, the speed change detector 30 of the present embodiment includes an encoder detection circuit 33 and a rotary encoder 34 including a slit disc 31 and a detection unit 32. The center of the slit disc 31 is fastened to an extension 10*b* of a rotary shaft 10*a* of the photoconductor drum 10. The detection unit 32 is disposed to sandwich a portion of the slid disc 31. The encoder detection circuit 33 operates the detection unit 32 and detects an output pulse signal from the detection unit 32.

Specifically, the slit disc 31 has a multitude of slits formed at equiangular intervals along the circumferential direction thereof The detection unit 32 includes a light-emitting element such as an LED and a light-receiving element such as a phototransistor disposed facing each other. The period of the output pulse signal from the light-receiving element of the detection unit 32 changes with the rotation speed of the slit disc 31. It is therefore possible to detect change in the rotation speed of the photoconductor drum 10, i.e., change in the moving speed in the sub-scanning direction of the surface of the photoconductor drum 10, by detecting the output pulse signal from the detection unit 32 with the encoder detection circuit 33 and comparing the period of the output pulse signal with the period corresponding to the target rotation speed. The encoder detection circuit 33 transmits a detection signal indicating the detection to the image control circuit 20.

A timing pulley 18 is fastened to the rotary shaft 10*a* of the photoconductor drum 10, and a timing belt 19 is wound around the timing pulley 18 and a second timing pulley fastened to a drive shaft of a motor. The photoconductor drum 10 is rotated in the direction of arrow A by the rotational drive force of the motor. Alternatively, it is also possible to detect the change in the moving speed in the sub-scanning direction of the surface of the photoconductor drum 10 by similarly detecting the rotation speed of the drive shaft (i.e., rotary shaft) of the motor or one of members forming a mechanism for transmitting the drive force to the photoconductor drum 10.

The LED array 13 is disposed over the entire width of an image forming region in the outer circumferential surface (i.e., image bearing surface) of the photoconductor drum 10 along the main-scanning direction (i.e., the axial direction of the photoconductor drum 10). The LED array drive unit 12, the image control circuit 20, and the controller 40 illustrated in FIG. 5 are those illustrated in FIG. 1.

Figure 6:
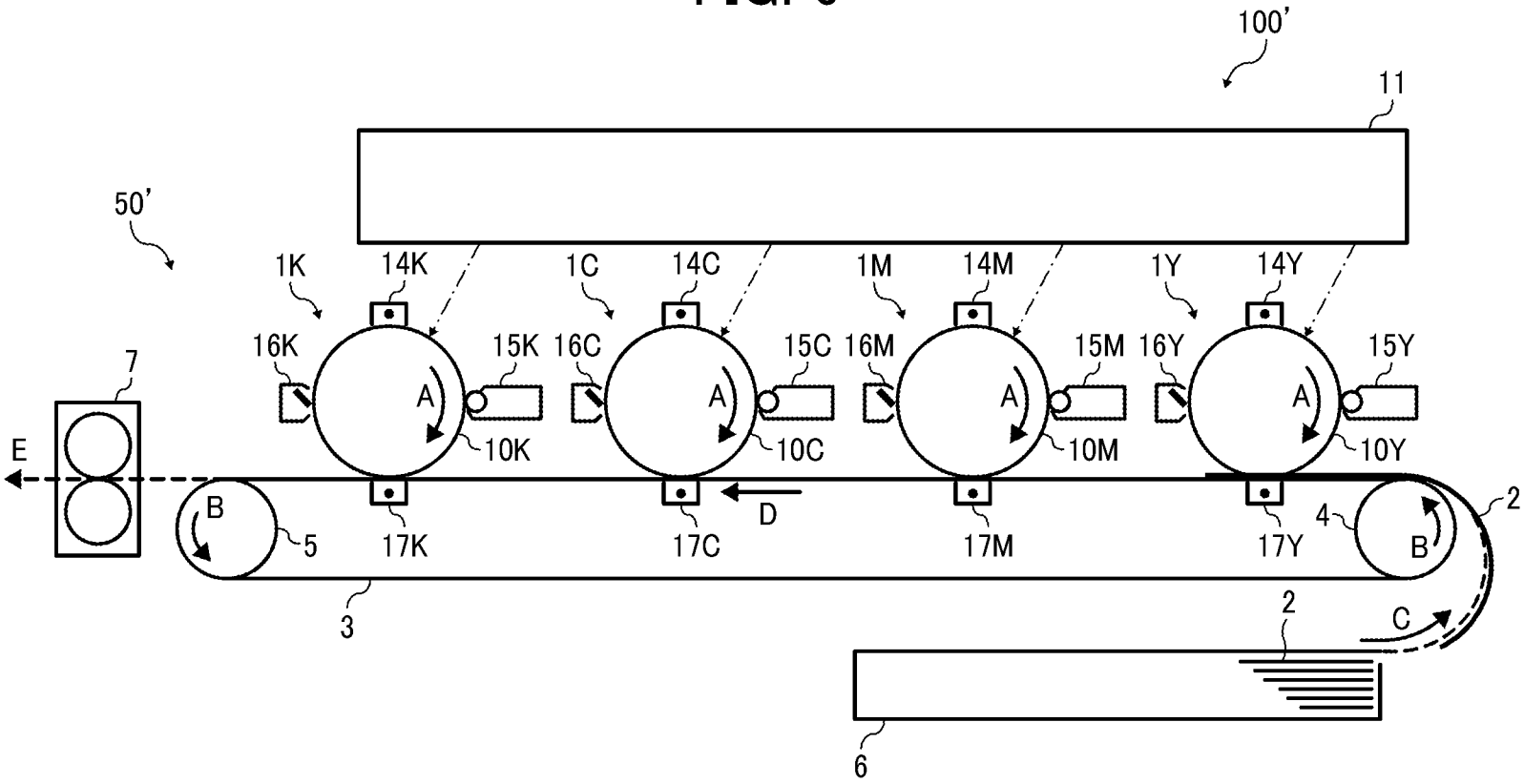
FIG. 6 is a schematic diagram illustrating a configuration of components near image forming units in an engine unit for color image formation in an image forming apparatus according to an embodiment of this disclosure.
Figure 7:
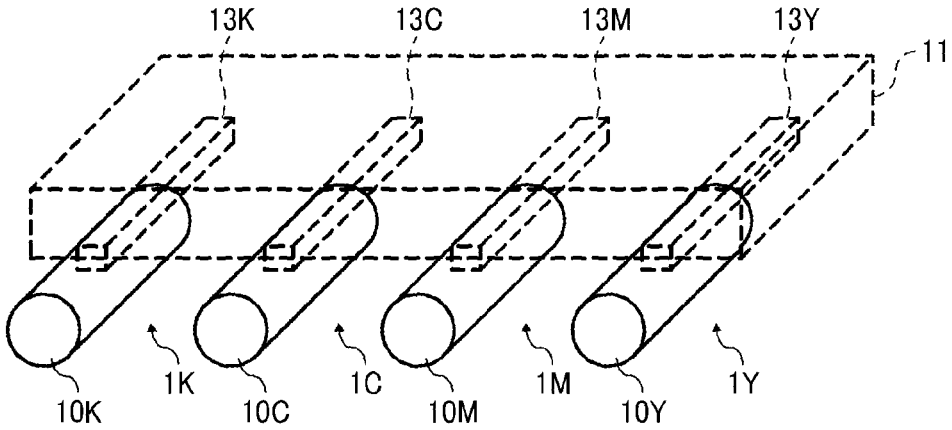
FIG. 7 is a schematic perspective view of photoconductor drums for respective colors and an exposure device in the image forming apparatus.

An engine unit in a color image forming apparatus according to an embodiment of this closure will now be described. With reference to FIGS. 6 and 7, description will be given of an embodiment in which this disclosure is applied to a color image forming apparatus.

FIG. 6 is a schematic diagram illustrating a configuration of components near image forming units 1Y, 1M, 1C, and 1K in an engine unit 50' for color image formation in an image forming apparatus 100' according to an embodiment of this disclosure. FIG. 7 is a schematic perspective view illustrating photoconductor drums 10Y, 10M, 10C, and 10K for respective colors and the exposure device 11. In FIG. 7, the exposure device 11 is indicated by broken lines.

The color image forming apparatus 100' includes a controller similar in configuration to the controller 40 of the image forming apparatus 100 illustrated in FIG. 3. If color print data is received from the host device 200, however, the controller develops the color print data into one page of bitmap image data for each color in a memory and transmits the image data for each color to an engine unit 50'.

The engine unit 50' illustrated in FIG. 6 is a direct-transfer, tandem image forming device capable of forming a full-color image. The engine unit 50' includes the four image forming units 1Y, 1M, 1C, and 1K that form images of four colors, i.e., yellow (Y), magenta (M), cyan (C), and black (K). The image forming units 1Y, 1M, 1C, and 1K are disposed at predetermined intervals along the moving direction of a transfer conveyance belt 3 (i.e., the direction of arrow D) that conveys the transfer sheet 2 serving as a recording medium.

The transfer conveyance belt 3 is stretched substantially horizontally between a drive roller 4 that is driven to rotate in the direction of arrow B by a drive motor and a driven roller 5 that is spaced apart from and level with the drive roller 4. Thereby, the transfer conveyance belt 3 is rotated in the direction of arrow D.

A sheet feeding tray 6 storing transfer sheets 2 is disposed below the transfer conveyance belt 3. In the image formation, the uppermost one of the transfer sheets 2 stored in the sheet feeding tray 6 is fed to the transfer conveyance belt 3 in the direction of arrow C, adsorbed onto the transfer conveyance belt 3 by electrostatic adsorption, and conveyed in the direction of arrow D to a transfer position in the image forming unit 1Y.

The image forming units 1Y, 1M, 1C, and 1K respectively include the photoconductor drums 10Y, 10M, 10C, and 10K and chargers 14Y, 14M, 14C, and 14K, developing devices 15Y, 15M, 15C, and 15K, photoconductor cleaners 16Y, 16M, 16C, and 16K, and transfer devices 17Y, 17M, 17C, and 17K disposed around the photoconductor drums 10Y, 10M, 10C, and 10K. Further, as illustrated in FIG. 7, LED arrays 13Y, 13M, 13C, and 13K are respectively disposed in the image forming units 1Y, 1M, 1C, and 1K.

In the image forming units 1Y, 1M, 1C, and 1K in FIGS. 6 and 7, suffixes Y, M, C, and K follow the reference numerals of the photoconductor drums 10Y, 10M, 10C, and 10K, the LED arrays 13Y, 13M, 13C, and 13K, the chargers 14Y, 14M, 14C, and 14K, the developing devices 15Y, 15M, 15C, and 15K, the photoconductor cleaners 16Y, 16M, 16C, and 16K, and the transfer devices 17Y, 17M, 17C, and 17K, for distinction purposes. However, the photoconductor drums 10Y, 10M, 10C, and 10K are the same in function, and thus will hereinafter be collectively referred to as the photoconductor drums 10 without suffixes Y, M, C, and K. The same applies to the other components.

As illustrated in FIG. 7, the LED array 13 is disposed in each of the image forming units 1Y, 1M, 1C, and 1K between the charger 14 and the developing device 15 near the circumference of the photoconductor drum 10 similarly to the image forming unit 1 illustrated in FIG. 4. Since the LED arrays 13 in the image forming units 1Y, 1M, 1C, and 1K are also included in the exposure device 11, only optical axes of the LED elements in the LED arrays 13 are indicated by broken arrows in FIG. 6. In the illustrated example, the single exposure device 11 is provided for the image forming units 1Y, 1M, 1C, and 1K, while each of the LED array 13 and the LED array drive unit 12 is provided for each of the colors. Alternatively, a separate exposure device may be provided for each of the colors.

In each of the image forming units 1Y, 1M, 1C, and 1K, the photoconductor drum 10 is rotated at a predetermined speed in the direction of arrow A, and the surface of the photoconductor drum 10 is uniformly charged by the charger 14 at the specified time. The surface of the photoconductor drum 10 is then exposed and scanned with light corresponding to the image of the corresponding color emitted by the LED elements of the corresponding LED array 13 in the exposure device 11 as indicated by the broken arrows. Thereby, an electrostatic latent image is formed on the surface of the photoconductor drum 10.

The electrostatic latent image is developed by the developing device 15 with toner of the corresponding color. Thereby, toner images of the respective colors are formed on the respective surfaces of the photoconductor drums 10 in the image forming units 1Y, 1M, 1C, and 1K.

The toner images of the respective colors are sequentially superimposed and directly transferred onto the transfer sheet 2 by the transfer devices 17 at the respective transfer positions at which the photoconductors drums 10 contact the transfer sheet 2 on the transfer conveyance belt 3. Thereby, a full-color image is formed on the surface of the transfer sheet 2. Residual toner remaining on the surfaces of the photoconductor drums 10 after the transfer process is cleaned off by the photoconductor cleaners 16 to prepare for the next image formation.

The transfer sheet 2 passed through the image forming unit 1K and having the full-color image formed thereon is separated from the transfer conveyance belt 3 and conveyed to the fixing device 7. The full-color toner image is then fixed on the transfer sheet 2 in the fixing device 7 and ejected in the direction of arrow E.

The engine unit 50' of the color image forming apparatus 100' includes four sets of the vlclr generation circuit 21, the lclr generation circuit 22, the HSYNC generation circuit 23, and the mfgate generation circuit 24 in the image control circuit 20 illustrated in FIG. 1 to use four sets of the first signal vlclr, the second signal lclr, and the image forming period signal mfgate. The line synchronization signal HSYNC is generated for each of the colors in synchronization with the second signal lclr from the start of the image formation synchronized with the first signal vlclr. The line synchronization signal HSYNC for each of the colors is transmitted to the LED array drive unit 12 of the corresponding color to control the timing of starting the image formation in the corresponding one of the image forming units 1Y, 1M, 1C, and 1K and the timing of image writing for each line by the corresponding LED array 13. This configuration allows precise adjustment of the sub-scanning registration for each of the colors and precise correction of the sub-scanning registration between the colors.

The engine unit 50' serving as the direct-transfer, tandem image forming device includes the transfer conveyance belt 3 that sequentially conveys the transfer sheet 2 to the transfer positions in the image forming units 1Y, 1M, 1C, and 1K for the respective colors. The transfer sheet 2 is an image bearer having a surface for bearing an image (i.e., an image bearing surface). It is therefore possible to detect the change in the moving speed in the sub-scanning direction of the surface of the transfer sheet 2 by detecting the change in the moving speed of the transfer conveyance belt 3 that electrostatically adsorbs and conveys the transfer sheet 2 at a predetermined target speed in the direction of arrow D corresponding to the sub-scanning direction. In this case, the change in the rotation speed of a rotary shaft of the drive roller 4 or the driven roller 5 in FIG. 6, the drive motor for rotating the drive roller 4, or one of members forming a mechanism for transmitting the drive force of the drive motor to the drive roller 4 may be detected for this purpose.

This disclosure is also applicable to a color image forming apparatus including an indirect-transfer, tandem or revolving image forming device. In this case, the color image forming apparatus includes an intermediate transfer member such as an intermediate transfer belt or an intermediate transfer drum, and toner images of respective colors formed in image forming units are primary-transferred, i.e., sequentially superimposed onto a surface of the intermediate transfer member, to form a full-color toner image. The toner images in the full-color toner image are then secondary-transferred onto a transfer sheet at one time. That is, the toner images of the respective colors formed in the image forming units are indirectly superimposed and transferred onto the transfer sheet serving as a recording medium.

In this case, the surface of the intermediate transfer member such as an intermediate transfer belt or an intermediate transfer drum moves in the sub-scanning direction at a predetermined target speed. It is therefore possible to detect the change in the moving speed in the sub-scanning direction of the surface (i.e., image bearing surface) of the intermediate transfer member by detecting the change in the moving speed of the surface of the intermediate transfer member. To detect the change in the moving speed, the change in the rotation speed of the intermediate transfer member, a motor for rotating the intermediate transfer member, or one of members forming a mechanism for transmitting the drive force of the motor to the intermediate transfer member may be detected.

The number of colors forming the color image is not limited to four, and may be two, three, five, or more.

The foregoing description has been given of some embodiments of this disclosure. This disclosure, however, is not limited to the above-described specific configurations and processes of the units in the embodiments.

For example, the photoconductor is not limited to the drum-shaped photoconductor, and may be a belt-type photoconductor. Further, the light-emitting elements arranged in the exposure head are not limited to the LED elements, and may be organic electroluminescence (EL) elements, for example.

Further, an image forming apparatus using an image writing device and an image writing method according to an embodiment of this disclosure is not limited to the printer, and may be a copier, a facsimile machine, or a multifunction peripheral having the functions of these apparatuses.

The configurations and functions of the foregoing embodiments may be added, changed, or partially omitted as appropriate, and may be implemented in combination as desired as long as there is no inconsistency in the combination.

An image writing device and an image writing method according to an embodiment of this disclosure is capable of correcting image unevenness and image misregistration due to a change in the moving speed in the sub-scanning direction of a surface (i.e., image bearing surface) of an image bearer, and precisely correcting sub-scanning registration at periods shorter than line periods.

The above-described embodiments are illustrative and do not limit this disclosure. Thus, numerous additional modifications and variations are possible in light of the above teachings. For example, elements or features of different illustrative and embodiments herein may be combined with or substituted for each other within the scope of this disclosure and the appended claims. Further, features of components of the embodiments, such as number, position, and shape, are not limited to those of the disclosed embodiments and thus may be set as preferred. Further, the above-described steps are not limited to the order disclosed herein. It is therefore to be understood that, within the scope of the appended claims, this disclosure may be practiced otherwise than as specifically described herein.

What is claimed is:

1. An image writing device comprising:

at least one exposure device including an exposure head having a plurality of light-emitting elements arranged in a main-scanning direction perpendicular to a sub-scanning direction in a plane extending along a surface of at least one image bearer that moves in the sub-scanning direction at a predetermined speed, the at least one exposure device using the exposure head to repeatedly expose the surface of the at least one image bearer along the main-scanning direction during an image forming period to write an image on the surface of the at least one image bearer;

at least one speed change detector to detect a change in a moving speed in the sub-scanning direction of the surface of the at least one image bearer;

at least one first signal generation circuit to generate a first signal having a constant period shorter than a period corresponding to a writing resolution in the sub-scanning direction;

at least one image forming period signal generation circuit to generate, in synchronization with the first signal, an image forming period signal specifying the image forming period;

at least one second signal generation circuit to generate a second signal having a period based on the period corresponding to the writing resolution in the sub-scanning direction and adjusted to reduce the effect of the detected change in the moving speed, the second signal initially appearing in the image forming period being in synchronization with the first signal; and at least one line synchronization signal generation circuit to generate, in synchronization with the second signal, a line synchronization signal specifying timing of the exposure and transmit the line synchronization signal to the at least one exposure device during the image forming period.

2. The image writing device according to claim 1, wherein the at least one image forming period signal generation circuit transmits, immediately before the image forming period, a notification signal for signaling approach of the image forming period to the at least one second signal generation circuit based on timing of generating the image forming period signal notified by a controller, and wherein, in response to the notification signal, the at least one second signal generation circuit generates the second signal initially appearing in the image forming period in synchronization with the first signal immediately following the notification signal.

3. The image writing device according to claim 1, wherein the exposure head is a light-emitting diode array having a plurality of light-emitting diode elements arranged in the main-scanning direction at a density corresponding to a writing resolution in the main-scanning direction.

4. The image writing device according to claim 1, wherein the at least one image bearer is one of a photoconductor and a member having a surface to which an image written on a surface of the photoconductor is transferred, and which moves in the sub-scanning direction.

5. The image writing device according to claim 1, wherein the at least one speed change detector detects the change in the moving speed in the sub-scanning direction of the surface of the at least one image bearer by detecting a change in a rotation speed of one of a rotary shaft of the at least one image bearer, a motor that drives the at least one image bearer, and a member forming a mechanism that transmits drive force of the motor to the at least one image bearer.

6. The image writing device according to claim 1, wherein the at least one image bearer includes a plurality of image bearers, the at least one exposure device includes a plurality of exposure devices, the at least one speed change detector includes a plurality of speed change detectors, the at least one first signal generation circuit includes a plurality of first signal generation circuits, the at least one image forming period signal generation circuit includes a plurality of image forming period signal generation circuits, the at least one second signal generation circuit includes a plurality of second signal generation circuits, and the at least one line synchronization signal generation circuit includes a plurality of line synchronization signal generation circuits.

7. An image forming apparatus comprising:

the image writing device according to claim 6; and an image forming device to develop images written on respective surfaces of the plurality of image bearers by the plurality of exposure devices in the image writing device into different colors, and directly or indirectly superimpose and transfer the images onto a recording medium.

8. An image forming apparatus comprising:

the image writing device according to claim 1; and an image forming device to develop the image written on the surface of the at least one image bearer in the image writing device, and transfer the image onto a recording medium.

9. An image writing method of writing an image on a surface of an image bearer that moves in a sub-scanning direction at a predetermined speed by repeatedly exposing the surface of the image bearer along a main-scanning direction perpendicular to the sub-scanning direction during an image forming period with an exposure head having a plurality of light-emitting elements arranged in the main-scanning direction in a plane extending along the surface of the image bearer, the image writing method comprising:

detecting a change in a moving speed in the sub-scanning direction of the surface of the image bearer;

generating a first signal having a constant period shorter than a period corresponding to a writing resolution in the sub-scanning direction;

generating, in synchronization with the first signal, an image forming period signal specifying the image forming period;

generating, with a signal generation circuit; a second signal having a period based on the period corresponding to the writing resolution in the sub-scanning direction and adjusted to reduce the effect of the detected change in the moving speed, the second signal initially appearing in the image forming period being in synchronization with the first signal; and generating, in synchronization with the second signal, a line synchronization signal specifying timing of the exposure during the image forming period.

10. The image writing method according to claim 9, further comprising:

transmitting, immediately before the image forming period, a notification signal for signaling approach of the image forming period to the signal generation circuit based on timing of generating the image forming period signal, wherein the generating of the second signal generates the second signal initially appearing in the image forming period in synchronization with the first signal immediately following the notification signal.

11. An image writing device comprising:

at least one exposure device including an exposure head having a plurality of light-emitting elements arranged in a main-scanning direction perpendicular to a sub-scanning direction in a plane extending along a surface of at least one image bearer that moves in the sub-scanning direction at a predetermined speed, the at least one exposure device using the exposure head to repeatedly expose the surface of the at least one image bearer along the main-scanning direction during an image forming period to write an image on the surface of the at least one image bearer;

means for detecting a change in a moving speed in the sub-scanning direction of the surface of the at least one image bearer;

means for generating a first signal having a constant period shorter than a period corresponding to a writing resolution in the sub-scanning direction;

means for generating, in synchronization with the first signal, an image forming period signal specifying the image forming period;

means for generating a second signal having a period based on the period corresponding to the writing resolution in the sub-scanning direction and adjusted to reduce the effect of the detected change in the moving speed, the second signal initially appearing in the image forming period being in synchronization with the first signal; and means for generating, in synchronization with the second signal, a line synchronization signal specifying timing of the exposure during the image forming period.

12. The image writing device according to claim 11, further comprising:

means for transmitting, immediately before the image forming period, a notification signal for signaling approach of the image forming period to the means for generating the second signal based on timing of generating the image forming period signal, wherein the means for generating the second signal generates the second signal initially appearing in the image forming period in synchronization with the first signal immediately following the notification signal.

* * * * *